United States Patent [19]

Averill

[11] Patent Number: 4,535,522

[45] Date of Patent: Aug. 20, 1985

[54] ANALYZER MAINTENANCE

[75] Inventor: John A. Averill, Randolph, Mass.

[73] Assignee: Allied Corporation, Morristown, N.J.

[21] Appl. No.: 575,760

[22] Filed: Feb. 1, 1984

[51] Int. Cl.[3] ..... B25B 27/14

[52] U.S. Cl. ..... 29/280

[58] Field of Search ..... 29/278, 280, 234, 255, 29/263, 213 E

[56] References Cited

U.S. PATENT DOCUMENTS

| | | | |
|---|---|---|---|
| 1,544,246 | 6/1925 | Leslie | 29/255 |
| 2,924,006 | 2/1960 | Boe | 29/280 |
| 4,110,886 | 9/1978 | Wendler et al. | 29/280 |
| 4,298,026 | 11/1981 | Ambers . | |
| 4,361,539 | 11/1982 | Weinberg et al. . | |

*Primary Examiner*—Robert C. Watson

*Attorney, Agent, or Firm*—Lowell H. McCarter

[57] ABSTRACT

A maintenance tool for removal of a valve sleeve assembly from a valve cavity in a flow through cell of a blood gas analysis system or the like includes insertion structure that has a lead portion and a support portion of cross sectional dimension greater than the lead portion and corresponding to the inner cross sectional dimension of the valve sleeve assembly, gripping structure carried by the insertion structure and movable between a retracted position and an extended position, the gripping structure in its extended position having a portion that extends radially beyond the lead portion at the end of the insertion structure, and actuating structure for moving the gripping structure between the retracted and extended positions. The insertion structure is adapted to be inserted into a valve sleeve assembly in a valve cavity with the gripping structure in the retracted position so that the support portion is piloted on the inner surface of the valve sleeve assembly and then the actuating structure is operated to place the gripping structure in its extended position so that subsequent withdrawal of the insertion structure supports and removes the valve sleeve from the valve cavity. The tool facilitates removal of microvalve sleeves from flow through cells of blood gas analyzer cuvettes for periodic inspection and seal replacement in a simple and efficient manner that does not damage precision surfaces of the valve cavity and that is easily used in the field.

4 Claims, 5 Drawing Figures

ANALYZER MAINTENANCE

This invention relates to analyzer systems for blood gas and the like, and more particularly to maintenance tools for components of such analyzer apparatus or the like.

A blood gas analysis system of the type shown in Weinberg et al. U.S. Pat. No. 4,361,540 includes a module which houses a thermally insulated integrated assembly with external electrical and fluid connections. That assembly includes, as an integrated unit, four electrode housings, a precision flow through cell, and two metal heater blocks with electrical heater pads for maintaining stable analysis temperature. Located centrally within the module assembly in the flow through cell is a microvalve assembly of the type shown in Ambers U.S. Pat. No. 4,298,026. That valve assembly cooperates with the electrochemical analysis systems to selectively interconnect sample flow and calibrating fluid flow paths. Required periodic maintenance of that valve assembly involves replacement of seal members carried by a valve sleeve. Disassembly and removal of the valve sleeve and seal members in the field is difficult and frequently results in damage to precision surfaces of the flow through cell or other components of the module. For these reasons the entire module is frequently returned to the factory for routine valve maintenance.

In accordance with the invention, there is provided a maintenance tool for removal of a valve sleeve assembly from a valve cavity in a flow through cell of a blood gas analysis system or the like that includes insertion structure that has a lead portion and a support portion of cross sectional dimension greater than the lead portion and corresponding to the inner cross sectional dimension of the valve sleeve assembly, gripping structure carried by the insertion structure and movable between a retracted position and an extended position, the gripping structure in its extended position having a portion that extends radially beyond the lead portion at the end of the insertion structure, and actuating structure for moving the gripping structure between the retracted and extended positions. The insertion structure is adapted to be inserted into a valve sleeve assembly in a valve cavity with the gripping structure in the retracted position so that the support portion is piloted on the inner surface of the valve sleeve assembly and then the actuating structure is operated to place the gripping structure in its extended position so that subsequent withdrawal of the insertion structure supports and removes the valve sleeve from the valve cavity. The tool facilitates removal of microvalve sleeves from flow through cells of blood gas analyzer cuvettes for periodic inspection and seal replacement in a simple and efficient manner that does not damage precision surfaces of the valve cavity and that is easily used in the field.

In a particular embodiment, the maintenance tool includes a handle and a shaft fixed to the handle; and the gripping structure includes a cam plate fixedly secured at one end of the shaft. The cam plate has a thickness dimension of less than one millimeter and a lobe portion of greater radial dimension than the shaft, and the insertion structure includes a stepped sleeve carried on the shaft. The sleeve has a cylindrical lead portion of axial length less than one centimeter, a cylindrical support section of diameter greater than the lead portion but less than two centimeters, a limit shoulder portion, and a bore that is eccentric with respect to the cylindrical surfaces of the lead and support portions. The shaft carried by the handle is disposed in the eccentric bore of the stepped insertion sleeve, and that sleeve is captured on the shaft by the cam plate. When the tool is inserted into a valve sleeve, the cylindrical lead portion provides support for toroidal seal members carried by the valve sleeve, the cylindrical support portion is in aligning engagement with the inner surface of the valve sleeve, and the cam plate is beyond the end of the valve sleeve when the limit shoulder engages the other end of the valve sleeve. In that position, rotation of the handle shifts the cam plate into a gripping position and subsequent axial withdrawal of the tool from the valve cavity carries the valve sleeve supported on the support surface from the cavity.

Other features and advantages of the invention will be seen as the following description of a particular embodiment progresses, in conjunction with the drawing, in which.

DESCRIPTION OF PARTICULAR EMBODIMENT

Figure 1:
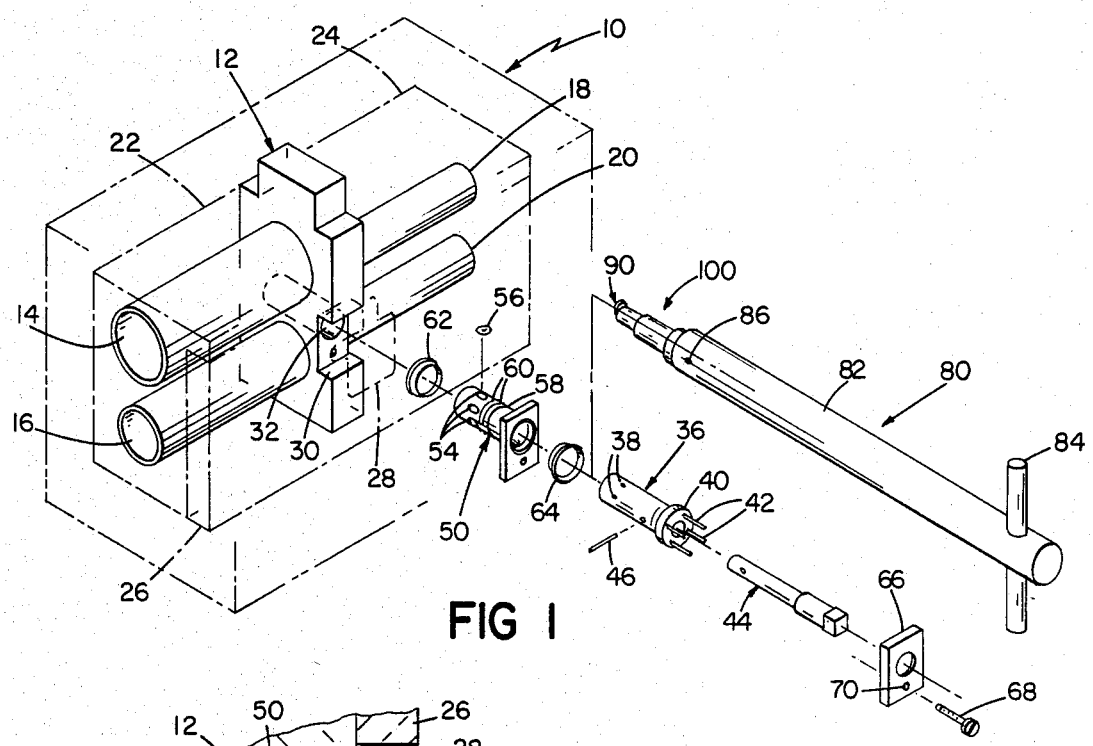
FIG. 1 is an exploded perspective view of valve components of a blood gas analysis module for use in a blood gas analysis system and a maintenance tool useful in disassembly of valve components.

The blood gas analysis module 10 shown in FIG. 1 is of the type disclosed in Weinberg et al. U.S. Pat. No. 4,361,540, the disclosure of which is incorporated herein by reference. That module 10 includes a flow through cell 12 fabricated from acrylic plastic which has four sleeves 14, 16, 18, 20 of the same material bonded to the cell body 12 to provide a leak proof unit. A flow through sample path in cell 12 interconnects $PCO_2$, pH, $PO_2$ and reference electrodes which are housed in sleeves 14, 16, 18 and 20. Within module 10 are aluminum heater blocks 22, 24 which are clamped in heat transfer engagement adjacent corresponding planar surfaces of cell 12 by aluminum plate 26 that has access port 28. Heater blocks 22, 24 carry heater pads and fluid preheater elements. Module 10 includes a front viewing window, a fiberglass thermal insulation sleeve disposed over the top, rear and bottom walls of the subassembly and cover structure, module 10 being about fifteen centimeters long, about eight centimeters high and about six centimeters deep.

Formed in the rear face of flow through cell member 12 is a rectangular recess 30 and a cylindrical valve recess 32 of about one centimeter diameter is in the rear wall of recess 30. In the cylindrical wall of recess 32 is 0.7 millimeter diameter port 34 (FIG. 5) of an inlet passage from one analysis chamber and a similar outlet passage extends radially outwardly from a corresponding oppositely located port in valve recess 32 to a second analysis chamber. A valve assembly includes a stainless steel spool 36 that is about two centimeters long and about $\frac{3}{4}$ centimeter in diameter. In the cylindrical surface of valve spool 36 are six ports 38. That spool has a flange 40 and carries four tubes 42 that extend outwardly from flange 40. Drive shaft 44 is secured in axially extending recess of valve spool 36 by pin 46.

Valve sleeve element 50 of Delrin includes a cylindrical tube portion that has a wall thickness of about one millimeter with a series of six apertures 54 arranged in a circumferential ring. Disposed in each aperture 54 is toroidal synthetic rubber seal member 56 that has an outer diameter of about $\frac{1}{3}$ centimeter, a cross-sectional diameter of about 1.2 millimeter, and an inner diameter of about one millimeter. Annular grooves 58 in the outer surface of sleeve 50 receive seal rings 60. Formed in the inner surface at either end of sleeve 50 are recesses which receive dynamic seals 62, 64.

Figure 2:
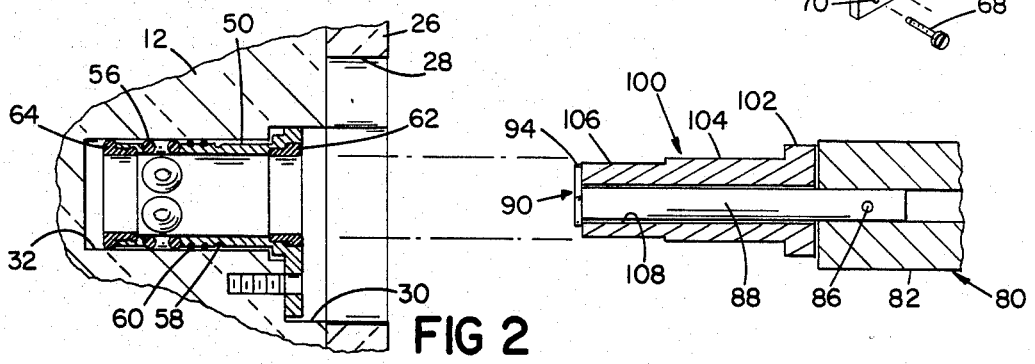
FIG. 2 is a sectional view showing the insertion portion of the maintenance tool and the valve sleeve in the analysis module.

Valve sleeve 50 is disposed within cylindrical recess 32 as indicated in FIG. 2, valve spool 36 is inserted into sleeve 50, and retainer plate 66 is disposed in recess 30 and secured with fastener 68 that passes through aperture 70. In that position, one of the seals 56 carried by sleeve 50 is aligned with and seals inlet port 34, a second seal 56 is aligned with the outlet port, and dynamic seals 62 and 64 provide running seals for the valve spool 36.

Figure 3:
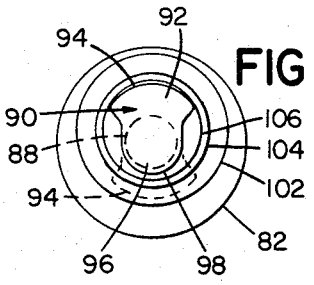
FIG. 3 is an end view of the maintenance tool.

Disassembly tool 80 has a cylindrical body portion 82 and a handle 84. Secured by pin 86 in and axially extending from a bore in the end of tool body 82 is stainless steel shaft 88 (FIG. 2) that has a diameter of about $4\frac{1}{2}$ millimeters, and a length of about four centimeters. Fixed to the end of shaft 88 is stainless steel cam plate 90 that has a thickness of about $\frac{1}{2}$ millimeter. As indicated in FIG. 3, plate 90 has major lobe 92 with arcuate surface 94 of about four millimeters radius from the axis of shaft 88 and minor lobe 92 with arcuate surface 98 of about $\frac{1}{4}$ centimeter radius.

Carried on shaft 88 is stepped sleeve 100 that has a length of about 2.3 centimeters, with a limit shoulder 102 of about 1.1 centimeter diameter and 0.3 centimeter length; intermediate cylindrical support surface 104 of about 1.2 centimeter length and about 0.8 centimeter diameter; and cylindrical lead surface 106 of about 0.7 centimeter diameter and about 0.8 centimeter length. Stepped sleeve 90 has a bore 108 of about 4.5 millimeter diameter that receives shaft 88 and that is about $\frac{1}{2}$ millimeter eccentric with respect to surfaces 102, 104 and 106.

Figure 4:
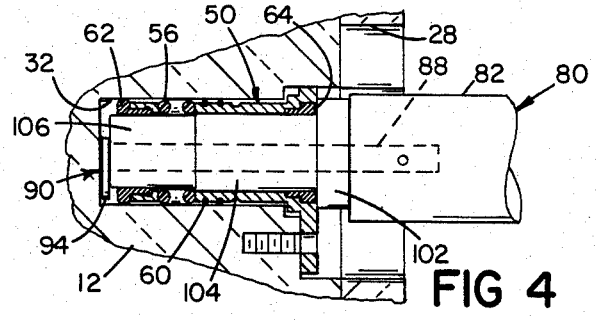
FIG. 4 is a sectional view showing the tip of the maintenance tool inserted in the valve sleeve.
Figure 5:
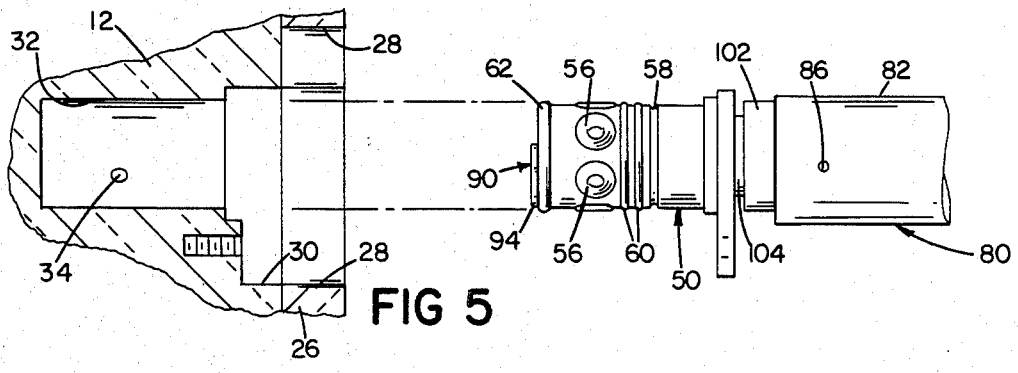
FIG. 5 is a view, partially in section, showing the maintenance tool carrying the valve sleeve removed from the analysis module.

When it is desired to remove valve sleeve 50, access to the valve assembly is obtained (after the module metal housing is removed) through opening 28 in back plate 26 to which the heater blocks 22, 24 are secured. After the valve spool 36 has been removed through the opening in the back plate, the cam (gripping) plate 90 and stepped sleeve 100 portions of tool 80 are inserted through opening 28 in back plate 26 and into the valve spool cavity 32 with lobe 92 generally aligned with lead surface 106 (the position shown in FIG. 2). As indicated in FIG. 4 intermediate surface 104 is piloted on the inner surface on the bore of sleeve 50 and lead surface 106 supports the toroidal seal rings 56. After tool 80 has been inserted to the position shown in FIG. 4, handle 84 is rotated 180° to turn cam plate 90 to the position shown in FIG. 4 so that lobe 92 extends radially beyond the end of sleeve and is in opposed and aligned relation to the inner dynamic seal 64. As tool 80 is then moved axially outwardly from module 10 lobe 92 engages dynamic seal 64, and continued application of axial force on tool 80, as guided and aligned by surface 104, carries the sleeve 50 from cavity 32 as indicated in FIG. 5 while maintaining support for the the O-ring seal 56 and other seals and without damage to the surfaces of the flow through cell 12 so that the seal members 56, 60, 62 and 64 can be inspected and replaced as necessary.

Disassembly tool 80 thus facilitates removal of valve sleeve 50 without damage to surfaces of flow through cell 14 and without requiring extensive disassembly of module 10.

While a particular embodiment of the invention has been shown and described, various modifications will be apparent to those skilled in the art, and therefore it is not intended that the invention be limited to the disclosed embodiment or to details thereof and departures may be made therefrom within the spirit and scope of the invention.

What is claimed is:

1. A maintenance tool for removal of a valve sleeve assembly from a valve cavity in a flow through cell of a blood gas analysis system or the like, comprising stepped sleeve structure having a cylindrical lead portion adapted to provide support for toroidal seal members carried by said valve sleeve, a cylindrical support portion of cross sectional dimension greater than said cylindrical lead portion and corresponding to the inner cross sectional dimension of said valve sleeve assembly for aligning engagement with the inner surface of said valve sleeve, and a limit shoulder for engaging an end of said valve sleeve, said stepped sleeve structure including a bore that is eccentric with respect to the cylindrical surfaces of said lead and support portions, a shaft disposed in said bore, gripping structure carried by said stepped sleeve structure including a cam member at the end of said stepped sleeve structure opposite said limit shoulder portion that is movable between a retracted position and an extended position, said cam member in said extended position having a portion that extends radially beyond said cylindrical lead portion at the end of said stepped sleeve structure, and handle structure for rotating said shaft to move said cam member between said retracted and extended positions, said stepped sleeve structure being adapted to be inserted into a valve sleeve assembly in a valve cavity with said cam member in said retracted position so that said cylindrical support portion is piloted on the inner surface of said valve sleeve assembly and then said handle structure is operated to place said cam member in said extended position so that subsequent withdrawal of said stepped sleeve structure supports and removes said valve sleeve from said valve cavity while concurrently providing support for said toroidal seal members.

2. The maintenance tool of claim 1 wherein said cam member has a lobe portion of greater diameter than said shaft.

3. The maintenance tool of claim 2 wherein said lead and support portions are coaxial cylindrical surfaces on said stepped sleeve structure.

4. The maintenance tool of claim 3 wherein said cam member has a thickness dimension of less than one millimeter, said lead portion has an axial length of less than one centimeter, and said support portion has a diameter of less than two centimeters.

* * * * *